US007458539B2

(12) United States Patent
Haven et al.

(10) Patent No.: US 7,458,539 B2
(45) Date of Patent: Dec. 2, 2008

(54) WINDER ROLL STARTING APPARATUS FOR THICK WEBS

(75) Inventors: Charles E. Haven, Kaukauna, WI (US); Keith G. Wiedow, De Pere, WI (US); David R. Mulry, Combined Locks, WI (US)

(73) Assignee: Metso Paper, Inc., Helsinki (FI)

( * ) Notice: Subject to any disclaimer, the term of this patent is extended or adjusted under 35 U.S.C. 154(b) by 586 days.

(21) Appl. No.: 11/140,397

(22) Filed: May 27, 2005

(65) Prior Publication Data

US 2006/0266871 A1 Nov. 30, 2006

(51) Int. Cl.
*B65H 19/28* (2006.01)

(52) U.S. Cl. ..... 242/532; 242/532.1; 242/532.2; 242/532.3

(58) Field of Classification Search ..... 242/532, 242/532.1–532.3, 542
See application file for complete search history.

(56) References Cited

U.S. PATENT DOCUMENTS 2,732,772 A 1/1956 Hornbostel
3,539,125 A * 11/1970 Patriksson ..... 242/523.1
3,908,924 A * 9/1975 Schulze ..... 242/527.3
4,125,659 A 11/1978 Klowak et al.
4,208,459 A 6/1980 Becker et al.
4,345,722 A * 8/1982 Kuhn ..... 242/527.4
4,370,193 A * 1/1983 Knauthe ..... 242/527.2
4,721,263 A 1/1988 Miyazaki
4,881,695 A 11/1989 Beisswanger
4,893,741 A 1/1990 Heinzmann
5,232,554 A 8/1993 Kotitschke
5,232,555 A 8/1993 Daunais et al.
6,338,451 B1 * 1/2002 Dorfel et al. ..... 242/527
6,581,868 B1 6/2003 Enwald et al.
2002/0106178 A1 * 8/2002 Bumgarner et al. ..... 385/137

* cited by examiner

*Primary Examiner*—Sang Kim
(74) *Attorney, Agent, or Firm*—Stiennon & Stiennon

(57) ABSTRACT

A winder has a scraper mounted about the axis of a winder drum for circumferential movement. The scraper has a semi-cylindrical concave surface which extends in the cross machine direction, the concave surface meets a second surface to form a scraping edge. The scraping edge engages the winder drum, scraping a web from the surface of the winder drum and pressing the web into engagement with double-sided sticky tape on a winder core with the concave surface. An alternative embodiment scraper has a flexible blade which extends in the cross machine direction and which functions similar to a spatula to scrape the pulp web off the surface of the winder drum and wipe the pulp web onto the double-sided sticky tape on the winding core.

10 Claims, 5 Drawing Sheets

WINDER ROLL STARTING APPARATUS FOR THICK WEBS

BACKGROUND OF THE INVENTION

The present invention relates to winders in general, and to apparatus for starting a new winding core in a winder in particular.

When paper, paperboard, or roll pulp is manufactured, it is initially wound into jumbo rolls at the end of a papermaking machine. The jumbo rolls are then processed through a slitter and winder which converts the jumbo roll into smaller rolls i.e., sets from which products are made, from newspapers to, in the case of roll pulp, diapers and sanitary napkins.

Roll pulp and products such as paperboard are relatively thick so that when wound onto a set roll, a roll of a selected diameter is rapidly formed. Once a set roll is formed, a new winding core must be placed in the winder, and a new tail or start formed by cutting the web must be attached to the new winding core. Roll pulp is a thick absorptive web which may be, for example, 1.2 mm thick. Roll pulp is used in such products as diapers and sanitary napkins. In such applications it is the present industry standard that no foreign material such as hot glue residuals find there way into the final product. For this reason, only double-sided sticky tape can be used to attach the web to a cardboard winding core. The tape stays with the cardboard winding core when the roll pulp is used and thus, unlike hot-melt glue, cannot find its way into the finished product.

The normal process of using a winder with roll pulp or board webs, which cannot be moved by an air blow, involves bringing the machine to a stop, slicing the web, placing double-sided sticky tape on a winding core and placing the core in the winder, and manually pressing the roll pulp web onto the double sided tape on the winding core, then winding a set and repeating the process. For thinner paper webs it is possible to automate the process becomes the web can be blown onto the winding core, or picked up by the double-sided sticky tape from the reeling drum. Neither of these processes work if the web is too stiff. With a thicker web it is necessary to start a new reel or set often, and when starting a new set it is necessary to press the thicker web onto the double-sided sticky tape by hand. These steps require significant labor and time, so that the winder may be operating less than half of the time.

What is needed is a way to increase productivity when rewinding thicker paper or fiber webs.

SUMMARY OF THE INVENTION

The winder of this invention has a scraper mounted about the axis of a winder drum for circumferential movement. The scraper has a body which has portions forming a semi-cylindrical concave surface which extends in the cross machine direction, the concave surface meets a second cross machine direction extending surface to form a scraping edge. The scraper pivots about the axis of the winder drum, with the scraper edge in engagement with the winder drum surface, and the concave surface facing in the direction of travel defined by the pivotal motion of the scraper about the axis of the winder drum. The concave surface of the scraper has a cylindrical radius such that the concave surface closely matches the surface of a winding core, so that when the scraper is moved about the winder drum axis the scraper edge comes between the winder drum and the web, pushing a web tail onto the concave surface of the scraper. Further motion of the scraper about the winder drum axis brings the scraper concave surface and the web tail into engagement with the winding core and presses the web tail against the winding core. Double-sided sticky tape on the winding core attaches the web to the winding core as the scraper concave surface presses the web tail against the winding core.

An alternative embodiment scraper has a flexible blade mounted in the cross machine direction which functions similar to a spatula, and which scrapes the pulp web off the surface of the winder drum and wipes the pulp web onto the double-sided sticky tape on the winding core.

It is a feature of the present invention to increase the productivity of a slitter winder by reducing the time required to change winding cores when heavier grades of paper, linerboard, and roll pulp are being processed.

It is another feature of the present invention to decrease the need for an operator to perform manual steps when rewinding heavier grades of paper, linerboard and roll pulp.

It is a yet further feature of the present invention to provide a system for positioning and moving a device to transfer and press a relatively heavy and stiff web onto a winding core.

Further objects, features and advantages of the invention will be apparent from the following detailed description when taken in conjunction with the accompanying drawings.

DESCRIPTION OF THE PREFERRED EMBODIMENTS

Figure 1:
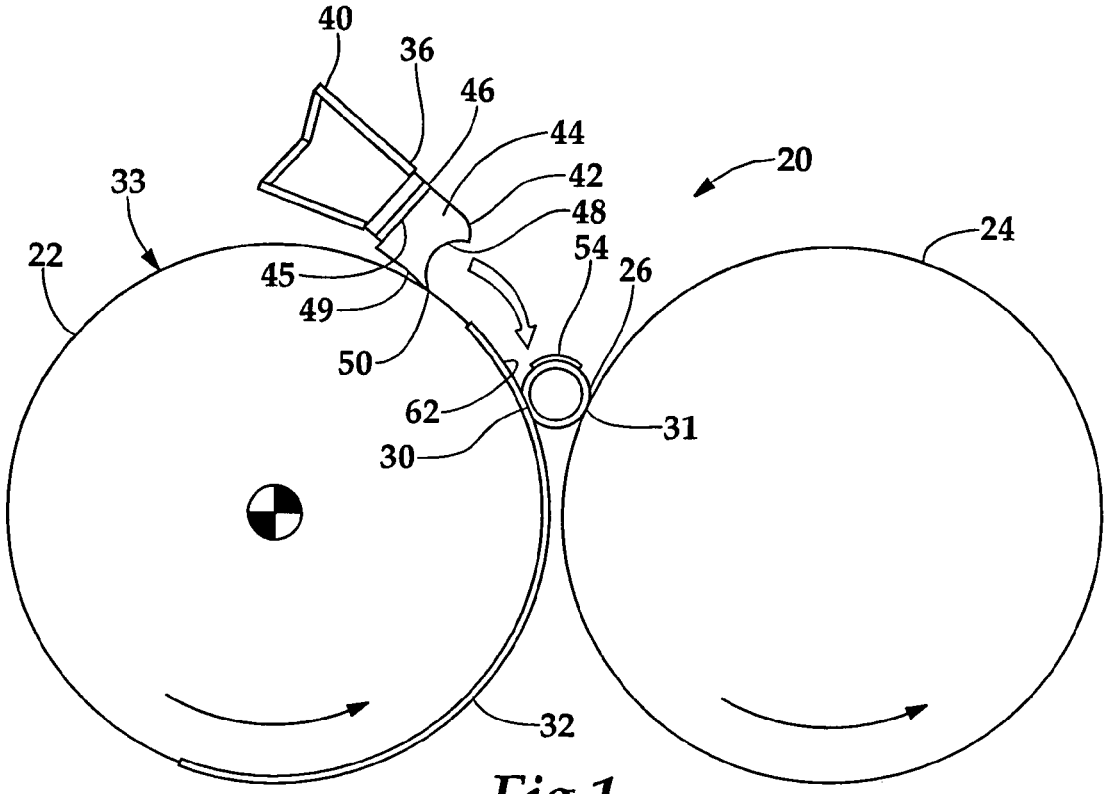
FIG. 1 is a schematic side elevational view of a winder of this invention, illustrating a scraper and pressing device engaged with a winder drum.
Figure 2:
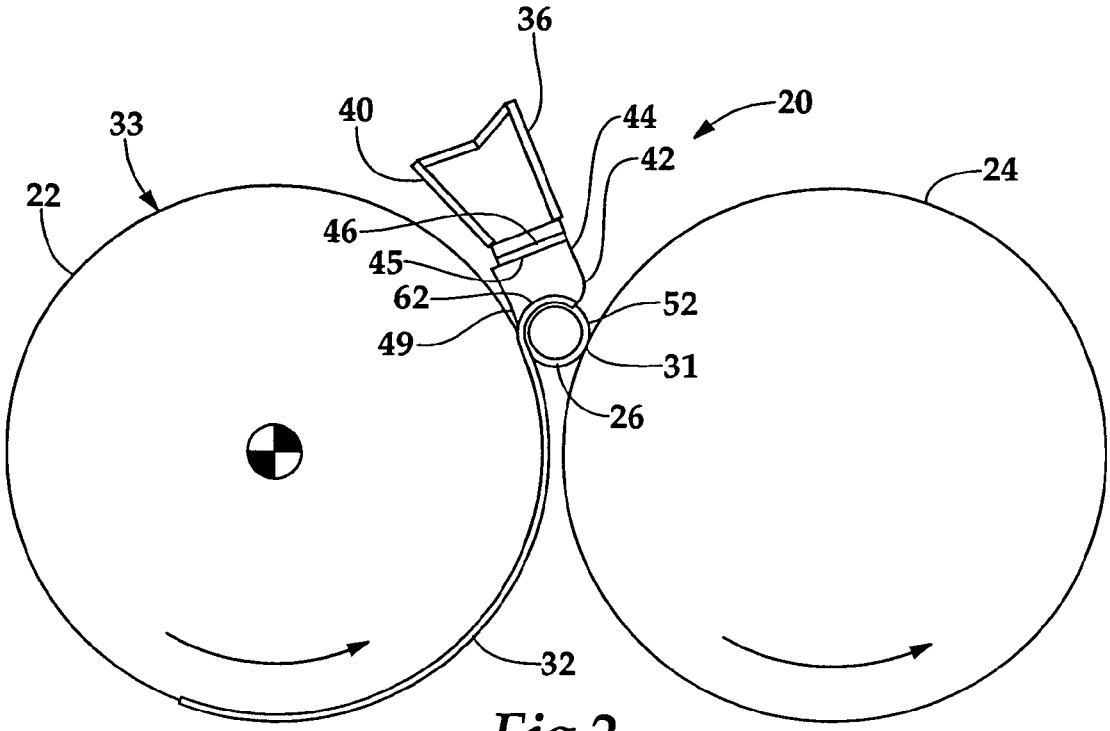
FIG. 2 is a schematic side elevational view of the winder of FIG. 1 illustrating the scraper and pressing device pressing a web against a winding core.
Figure 3:
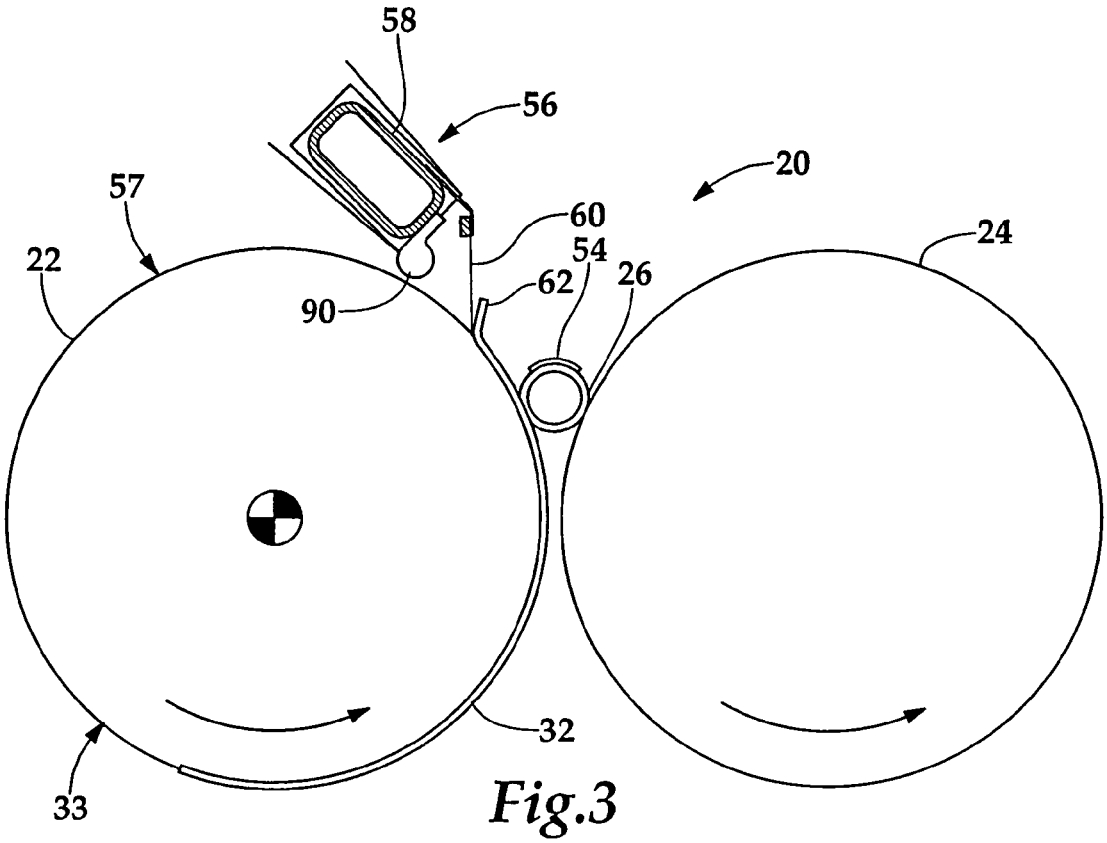
FIG. 3 is a schematic side elevational view of an alternative embodiment of the winder of this invention, showing an alternative embodiment scraper engaged with a winding drum.

Referring more particularly to FIGS. 1-7, wherein like numbers refer to similar parts, a twin drum winder 20 is shown in FIGS. 1-4, and 6-7. As shown in FIG. 1, the winder 20 has a rear winder drum 22 and a front winder drum 24 in spaced parallel relation, on which a winding core 26 is positioned for the winding of a roll. A scraping and pressing device 36 is mounted with respect to the winder 20 to facilitate the attachment of a pulp web 32 to the core 26. After a completed roll set has been wound, the winder is stopped, the completed roll set removed, and, as shown in FIG. 1, a new winding core 26 is positioned between the rear winder drum 22 and the front winder drum 24 such that the core forms a first nip 30 with the rear winder drum 22 and a second nip 31 with the front winder drum 24. The pulp web 32 extends along the cylindrical surface 33 of the rear winder drum 22, and, when the winding core is positioned in the winder, the web 32 is held in the nip 30 between the winding core 26 and the rear winder drum 22. The scraping and pressing device 36 is mounted above the winder 20 and is arranged to engage and move along the cylindrical surface 33 of the rear winder drum 22 until the scraping and pressing device presses the pulp web 32 against the winding core as shown in FIG. 2. The scraping and pressing device 36 has a cross machine direction extending beam 40, to which a scraping structure 42 is attached.

The scraping structure of 42 is comprised of a plurality of cross machine direction sections 44 e.g., one every 10 to 12 inches, of ultrahigh molecular weight (UHMW) plastic such as polyethylene, which are mounted to the scraping structure 42 by elastic pads 46. The sections 44 have portions 45 which engage the elastic pads 46, and portions forming a concave cross machine direction extending semi-cylindrical surface 48. The concave surface 48 meets a second cross machine direction extending surface 49 to form a scraping edge 50.

To start a new winding core 26 in the winder 20, the winder is brought to a stop, and a completed roll set (not shown) is removed from the winder 20. The pulp web 32 is cut to form a tail 62, as shown in FIG. 1. The new winding core 26 is then positioned between the two winding drums 22, 24. The winding core 26 has a cylindrical surface 52 on which a strip of double-sided sticky tape 54 has been adhered. The scraping edge 50 of the scraping and pressing device 36 is then moved along the cylindrical surface 33 of the rear winder drum 22, as shown in FIG. 2, to scrape the pulp web 32 away from the rear winder drum cylindrical surface 33 so that it travels upwardly along the concave surface 48 of the scraping structure 42. After the scraping and pressing device 36 is brought into engagement with the rear winder drum cylindrical surface 33 it is moved circumferentially about the rear drum 22. The continued motion of the beam 40 and the scraping structure 42 causes the concave surface 48 of the scraping structure 42 to engage the surface 52 of the winding core 26, pressing the pulp web 32 against the double-sided sticky tape 54 on the core surface 52 to attach the pulp web 32 to the winding core 26. Thus the entire process of starting a new set in the winder 20 of a web 32 such as a roll pulp web, may be automated, thus improving productivity and worker safety.

Figure 4:
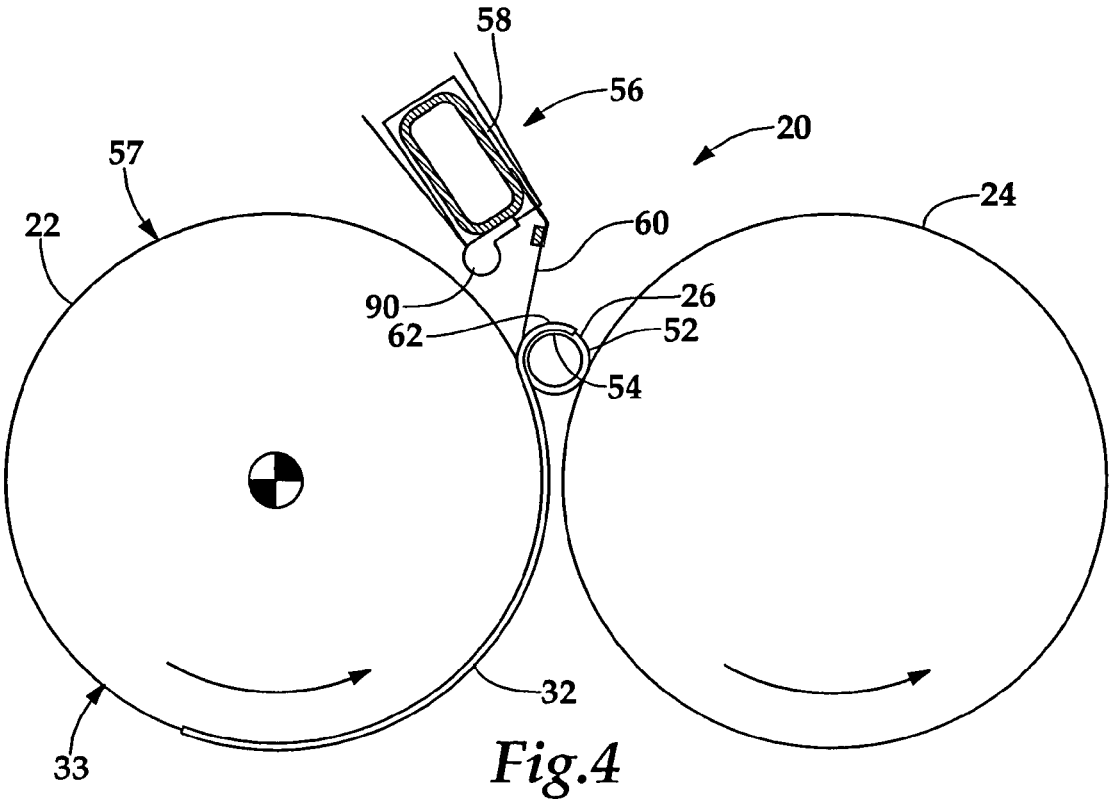
FIG. 4 is a schematic side elevational view of the winder of FIG. 3 showing the alternative embodiment scraper pressing a web against a winding core.
Figure 5:
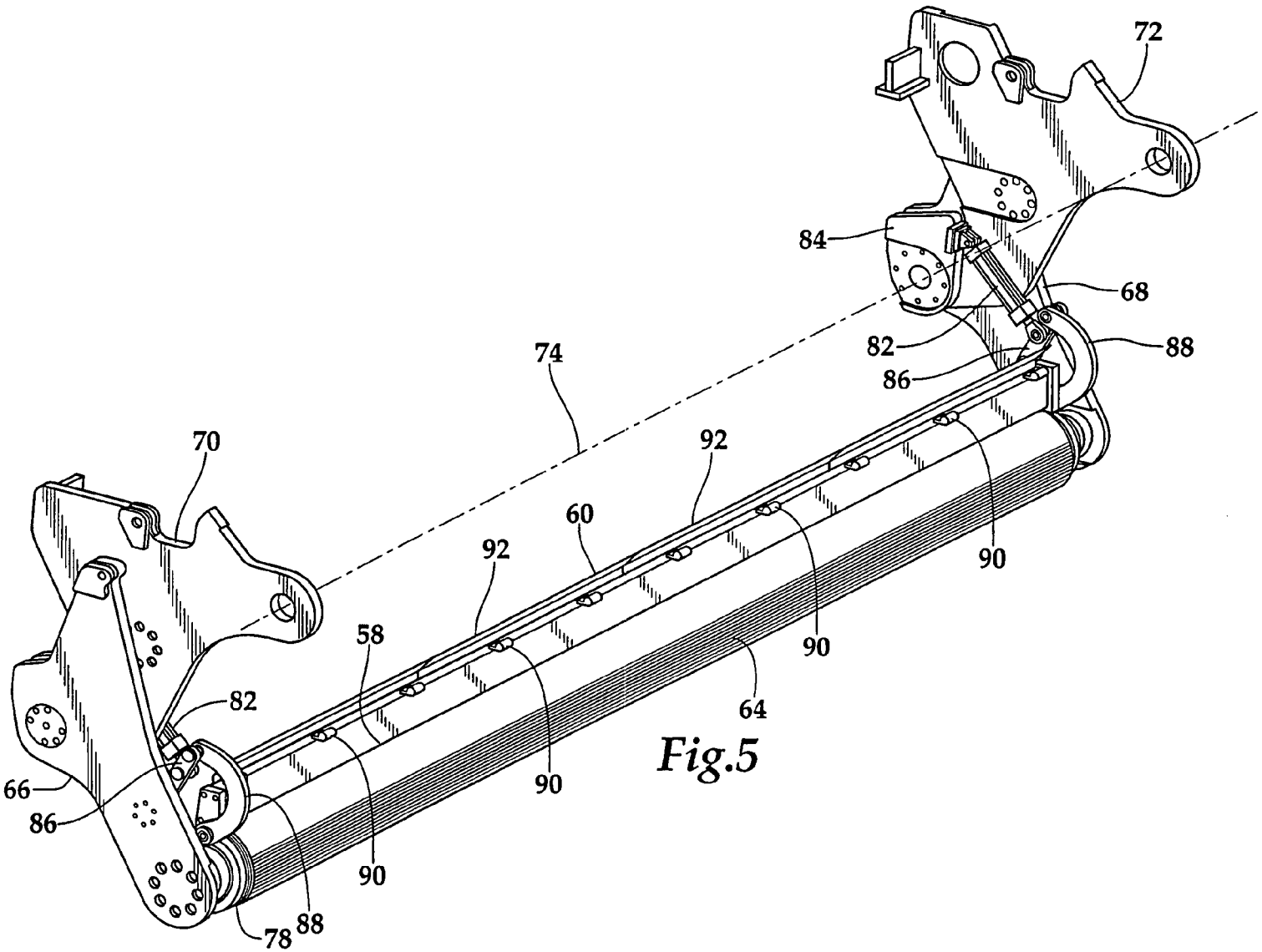
FIG. 5 is an isometric view of the structure which holds and positions the alternative embodiment scraper of FIG. 3.
Figure 6:
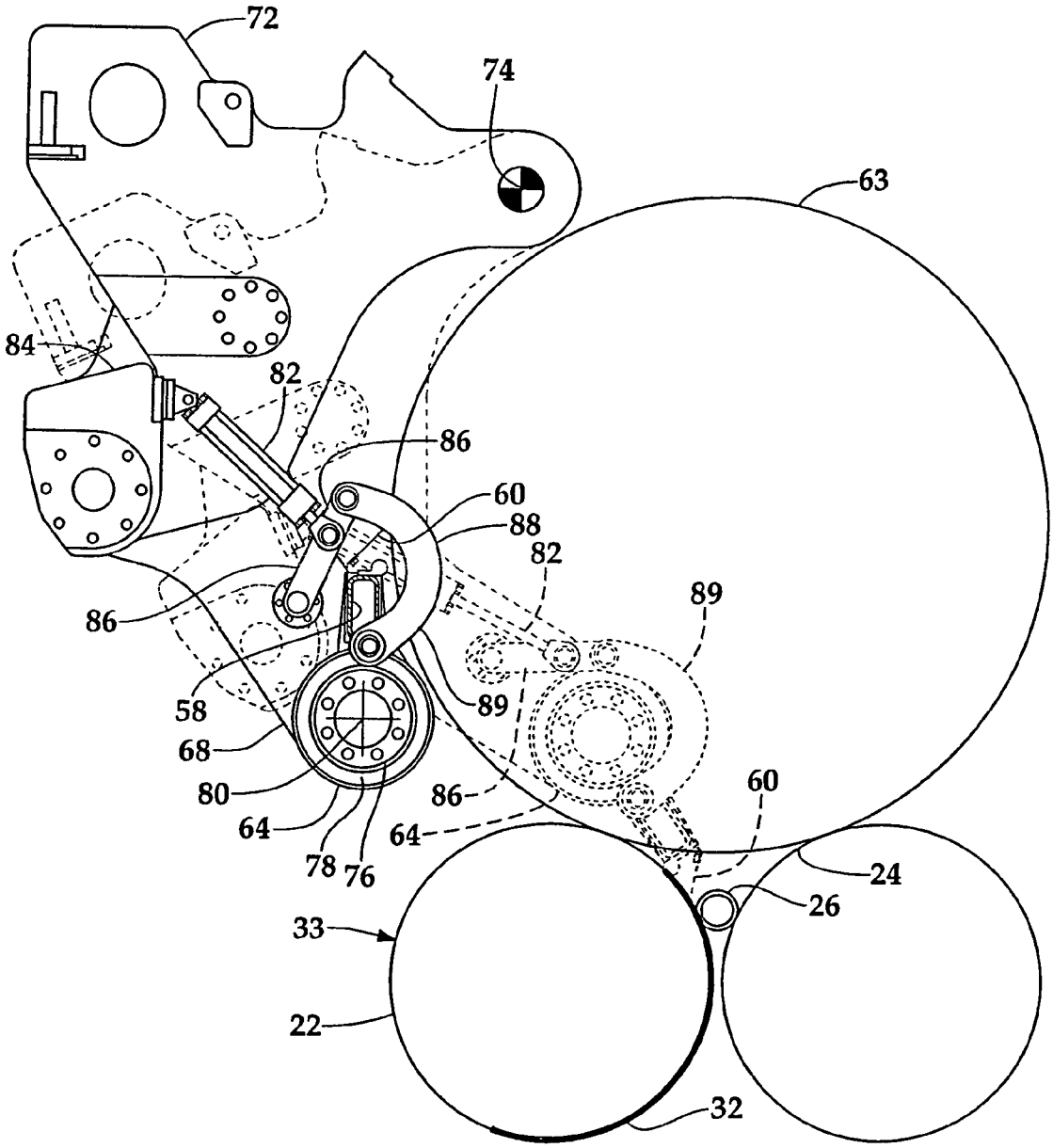
FIG. 6 is a side elevational illustrative view of the alternative embodiment winder of FIG. 3 showing the movement of the alternative embodiment scraper from a retracted position to a winding core wiping position.
Figure 7:
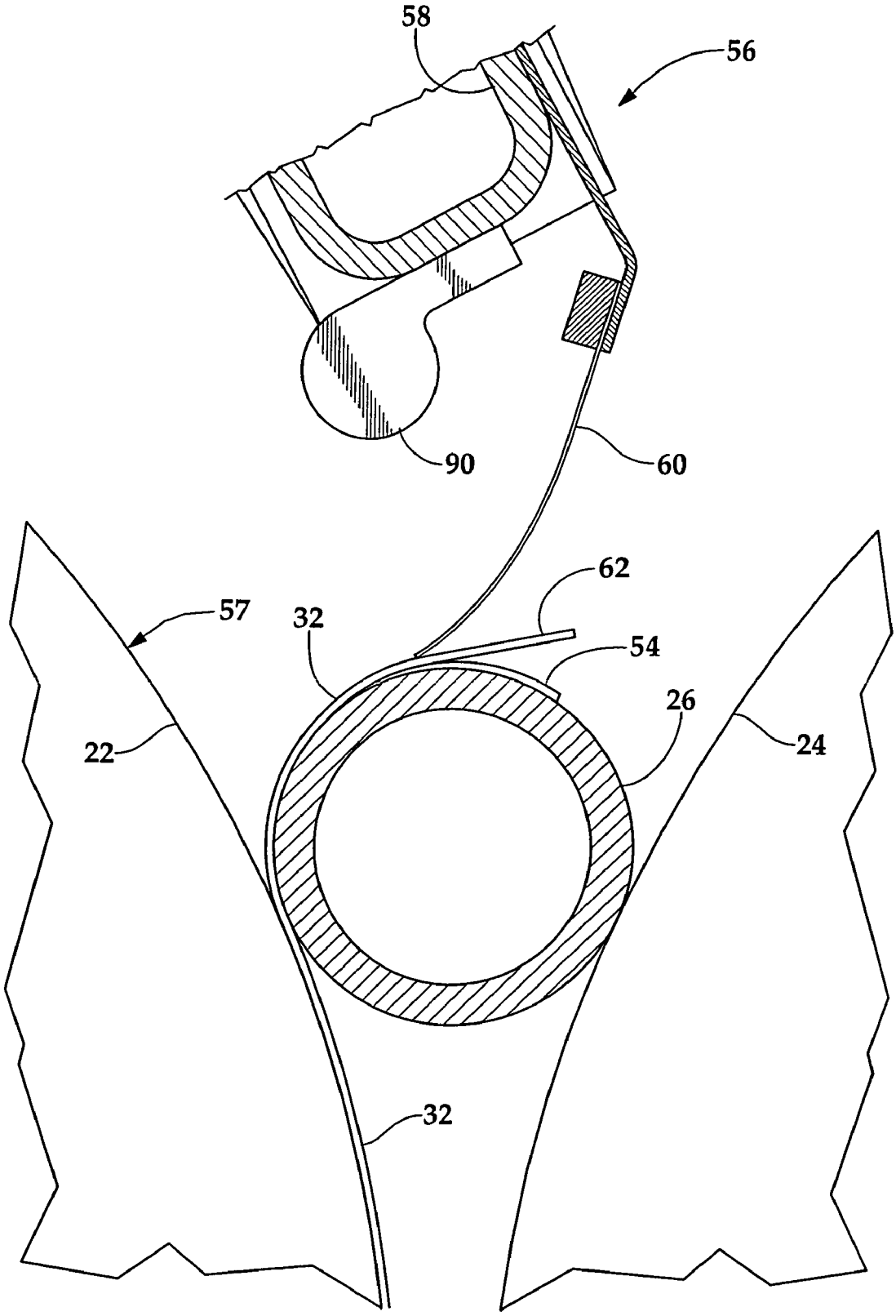
FIG. 7 is a detailed illustrative side elevational view of the alternative embodiment scraper of FIG. 3 wiping a pulp web onto double-sided sticky tape on a winding core.

An alternative embodiment scraping and pressing device 56 is shown in FIGS. 3-7. The scraping and pressing device 56 has a cross machine direction beam 58 to which is mounted a flexible 28 GA 4.75 inch-long stainless steel blade 60 which extends the full width in the cross machine direction of the winding core 26. The blade 60 is brought into engagement with a portion 57 of the cylindrical surface 33 of the drum 22, and then moved along the drum cylindrical surface 33 to separate the web tail 62 from the rear winder drum 22. As shown in FIGS. 4 and 7, the blade 60 presses the web 32 against the double-sided sticky tape 54 on the winding core 26 by wiping the web tail 62 on to the double-sided sticky tape 54 on the surface 52 of the winding core 26. Flexing of the blade 60 causes a controlled amount of pressure to be applied to the web 32 against the winding core 26, which pressure is controlled by the spring constant of the blade 60 as it flexes, bending in an upstream machine direction.

The scraping and pressing device 56 is preferably provided with a cylindrical pushing beam 64 which has an axis 80. As shown in FIG. 5, the pushing beam 64 is a roll which is mounted for rotation between a first roll frame 66, and a second roll frame 68. As shown in FIG. 6, when a reel or set 63 is completed on the winder drums 22, 24, the pushing beam 64 is used to push the set 63 out of the winder 20. The roll frames 66, 68 are in turn mounted to first and second pivot frames 70, 72 which pivot about a pivot axis 74. Rotation of the first and second pivot frames 70, 72 causes the pushing beam 64 to engage and push the reel 63 out of the winder 20. After the reel 63 is removed from the winder 20 the pivot frames 70, 72 are retracted. A winding core insert mechanism (not shown) then drops a winding core 26 between the winder drums 22, 24. The winding core 26 has a piece of cross machine direction extending double-sided sticky tape 54 disposed thereon. As shown in FIG. 7, the winding core 26 is positioned with the tape 54 facing upwardly so that the blade 60 can wrap the tail 62 of the web 32 over the winding core and the tape 54.

The cross machine direction beam 58 and the flexible blade 60 mounted thereon, are mounted for rotation to bearings 78. The beam 58 and attached blade 60 rotate together on the bearings about the pushing beam shaft 76.

The cross machine direction beam 58 is thus mounted by the bearings 78 about the axis 80 of the pushing beam 64, so the cross machine direction beam 58 and the flexible blade 60 are rotatable about the axis 80. Rotation about the axis 80 is caused by hydraulic actuators 82, best shown in FIG. 5, which are mounted between flanges 84 fixed to the roll frames 66, 68 and the first links 86 of the two link arms 88. The first links 86 of the two link arms 88 are rotatably mounted at one end to bearings fixed to the roll frames 66, 68, and rotatably mounted at the other ends to C-shaped links 89. The C-shaped links 89 are in turn pivotally mounted to the bearings 78. Extension of the hydraulic actuators 82 causes the cross machine direction beam 58 and the blade 60 mounted thereto to rotate about the axis 80 of the pushing beam 64. The combination of rotation of the pivot frames 70, 72 about the pivot axis 74 and of the rotation of the cross machine direction beam 58 about the pushing beam roll axis 80 causes the motion between the retracted position and the extended position illustrated in FIG. 6. Motion between the retracted position of the cross machine direction beam 58 and attached flexible blade 60, and the extended position as shown in FIG. 6 is thus the result of the combination of rotation of the pivot frames 70, 72 approximately 25 degrees, and the rotation of the beam 58 about the pushing beam axis 80 by about 150 degrees. It should be noted that FIG. 6 combines views from both ends of the structure of FIG. 5 in order to better illustrate the operation of the scraping and pressing device 56.

Plastic P-shaped structures 90, best shown in FIGS. 5 and 7, are mounted to the cross machine direction beam 58. The P-shaped structures 90 may be formed of ultrahigh molecular weight plastic or other suitable plastic and serve to prevent metal on metal contact between the cross machine direction beam 58 and the winder drum 22, or between the blade 60 and the cross machine direction beam 58. For ease of manufacture, the blade 60, as shown in FIG. 5, may be constructed of a plurality of segments 92. Moreover, if necessary to allow for cross machine direction variations, the blade may be made up of a multiplicity of short cross machine direction segments to better conform to the winder drum and the winding core 26.

It should be understood that various mechanical arrangements could be used to control the motion of the scraping and pressing device 36 or 56 so as to separate the web tail 62 from the winder drum surface 33 and to press the tail on to a winding core.

It should also be understood that the blade 60 can be constructed of any thin sheet of metal or any other suitable flexible material which can flex so that the wiping action applies an even and controlled pressure to the web tail against the winding core. For example, the blade can be constructed of a 4.75 inch long, in the machine direction, piece of 28 Gage 301 stainless tempered spring steel, of a selected spring constant, such that the blade applies a force to the web on the winding core of about 3 to 4 lbs/linear inch. The blade force on the web and the core can be adjusted by positioning the blade in relation to the winding core. The blade typically wipes approximately a 60 degree sector of the winding core where the tape is present beneath the web. Hot melt glue or other means of binding the web to the core are also possible with the blade wiping action performing the same function by pressing the web to the winding core to form a bond therebetween.

It should be understood that the pressing devices 36 or 56 are particularly useful for transferring a relatively thick web such as board, liner board, and roll pulp onto a winding core. Ordinary paper webs are generally less than 0.010 inches thick whereas board, liner board, and roll pulp are thicker, generally greater than about 0.020 inches thick, and typically 0.040 to 0.060 inches thick for a roll pulp web. It should also be noted that the thick web may not lie on the the surface 57, but, because of the web's inherent stiffness, may be separated from the surface 57 after the nip 30. Thus the scraping action of the scraping and pressing device 36, 56, may constitute no more than the interposing of portions of the scraping and pressing device (i.e. the scraping structure 42, or the blade 60) between the web tail 62 and the drum surface 57.

It is understood that the invention is not limited to the particular construction and arrangement of parts herein illustrated and described, but embraces all such modified forms thereof as come within the scope of the following claims.

We claim:

1. An apparatus for attaching a fiber web start to a winding core, the apparatus comprising:

a winder drum having a cylindrical surface and an axis of rotation, wherein the direction in which the axis extends defines a cross machine direction;

a winding core, having a cylindrical surface, the core being of a selected length and a selected winding core radius, wherein the cylinder surface forms a first cross machine direction extending nip with the cylindrical surface of the winder drum;

a cross machine direction extending scraping and pressing structure, the structure being mounted above the winding core and having portions defining a flexible blade of a selected spring constant, wherein the scraping and pressing structure is mounted for movement with respect to the winder drum, so that the flexible blade moves along a portion of the cylindrical surface of the winder drum upstream of the first nip, towards the winding core, and is further mounted so the flexible blade comes into engagement with the cylindrical surface of the winding core and then moves across the winding core in a wiping action.

2. The apparatus of claim 1 wherein the scraping and pressing structure is mounted for rotation about two spaced apart cross machine direction axes, which together are arranged to provide the motion such that the flexible blade comes into engagement with the cylindrical surface of the winding core and then moves across the winding core in the wiping action.

3. The apparatus of claim 1 further comprising a second winder drum having a second cylindrical surface, wherein the second winder drum is mounted for rotation and positioned to engage the winding core to form a second cross machine direction extending nip with the cylindrical surface of the winding core.

4. The apparatus of claim 1 further comprising a quantity of double-sided sticky tape mounted on the winding core cylindrical surface.

5. An apparatus for attaching a stiff fiber web start to a winding core, the apparatus comprising:

a rear winder drum, having a first cylindrical surface and a first axis of rotation, wherein the direction in which the axis extends defines a cross machine direction;

a front winder drum, having a second cylindrical surface and a second axis of rotation, the front winder drum being in spaced parallel relation to the rear winding drum;

a winding core having a cylindrical surface, and being of a selected length and a selected winding core radius, the cylinder surface forming a first cross machine direction extending nip with the first cylindrical surface of the rear winder drum, and a second cross machine direction extending nip with the second cylindrical surface of the front winder drum;

a cross machine direction extending beam mounted above the winding core;

a flexible blade of a selected spring constant, mounted to the beam and extending in the cross machine direction, wherein the beam is mounted for movement with respect to the first winder drum, so that the flexible blade moves along a portion of the first cylindrical surface of the winder drum upstream of the first nip, toward the winding core, and is further mounted so the flexible blade comes into engagement with the cylindrical surface of the winding core and then moves across the winding core in a wiping action.

6. The apparatus of claim 5 wherein the beam is mounted for rotation about a first cross machine direction axis and a second cross machine direction axis, which together are arranged to provide the motion of the flexible blade along the first cylindrical surface, and said wiping action across the winding core.

7. The apparatus of claim 6 further comprising a roll mounted for rotation about the first axis, the roll arranged to translate in response to motion about the second roll axis to push a completed reel from a winder.

8. A method for starting a reel about a winding core in a twin drum winder comprising the steps of:

moving a cross machine direction extending scraping and pressing structure from a position above the twin drum winder to a position between a fibrous web start having a thickness greater than about 0.010 inches, and a surface of a rear winding drum of the twin drum winder;

moving the cross machine direction extending scraping and pressing structure so as to push the web start against a winding core positioned between the rear winding drum and a front winding drum of the twin drum winder;

mechanically pressing with the cross machine direction extending scraping and pressing structure the web start against a sticky portion of the winding core to bond the web start to the winding core;

wherein the cross machine direction extending scraping and pressing structure has a portion biased by a selected spring constant which is wiped over the winding core to press the web start over a region corresponding to the sticky portion of the winding core.

9. The method of claim 8 wherein the portion biased by a selected spring constant is the flexible blade which is first positioned between the web start and the rear winding drum and then moved so as to wipe with a pressing action the web start over the region corresponding to the sticky portion of the winding core.

10. The method of claim 8 wherein the web thickness is greater than about 0.020 inches.

* * * * *